US009492709B2

(12) United States Patent
Dilli et al.

(10) Patent No.: US 9,492,709 B2
(45) Date of Patent: Nov. 15, 2016

(54) TREADMILL APPARATUS THAT MEASURES GAIT PARAMETERS USING FOUR OR FEWER LOAD CELLS

(71) Applicant: Mobility Research, Inc., Tempe, AZ (US)

(72) Inventors: Dave Dilli, Phoenix, AZ (US); Mohammed Ehsan, Phoenix, AZ (US); Amir Seif, Phoenix, AZ (US); Ryan Bellman, Tempe, AZ (US)

(73) Assignee: Mobility Research, Inc., Tempe, AZ (US)

( * ) Notice: Subject to any disclaimer, the term of this patent is extended or adjusted under 35 U.S.C. 154(b) by 0 days.

(21) Appl. No.: 14/565,792

(22) Filed: Dec. 10, 2014

(65) Prior Publication Data

US 2016/0166879 A1 Jun. 16, 2016

(51) Int. Cl.
*A63B 24/00* (2006.01)
*A63B 22/02* (2006.01)

(52) U.S. Cl.
CPC ..... *A63B 24/0062* (2013.01); *A63B 22/02* (2013.01)

(58) Field of Classification Search
CPC ... A63B 24/00; A63B 24/0062; A63B 22/02
See application file for complete search history.

(56) References Cited

U.S. PATENT DOCUMENTS 4,987,602 A * 1/1991 Brunner ..... G01D 7/10 345/428
5,623,944 A 4/1997 Nashner
6,645,126 B1 11/2003 Martin et al.
8,002,672 B2 8/2011 Brunner
8,551,026 B2 * 10/2013 Alwan ..... A61B 5/1038 340/573.1
8,790,279 B2 * 7/2014 Brunner ..... A61B 5/1038 463/6
2007/0004563 A1 * 1/2007 Reyes ..... A63B 24/00 482/54
2009/0062695 A1 3/2009 Sauvignet et al.
2009/0124938 A1 * 5/2009 Brunner ..... A61B 5/1038 600/595
2010/0035727 A1 * 2/2010 Brunner ..... A61B 5/1038 482/8
2015/0140534 A1 * 5/2015 Brunner ..... A63B 22/025 434/255
2015/0173652 A1 * 6/2015 Brunner ..... A63B 24/0087 482/7

* cited by examiner

*Primary Examiner* — Glenn Richman
(74) *Attorney, Agent, or Firm* — Etherton Law Group, LLC

(57) ABSTRACT

This gait analysis apparatus comprises three, and preferably four, vertical force sensors disposed between a treadmill and the ground. When a person walks on the treadmill belt, each force sensor emits an electronic signal proportional to the load on the frame. The sensors measure the load hundreds of times per second and that data, in combination with the speed of the treadmill belt, enables a processing unit to calculate many gait parameters. The resultant calculations are displayed to the clinician in numeric and graphical formats. Due largely to the few number of force sensors, the apparatus is relatively inexpensive compared to existing gait parameter apparatuses and can be easily retrofitted to existing treadmills by either replacing the treadmill's existing ground supports with force sensors or resting the treadmill on top of a frame that has integral force sensors.

17 Claims, 8 Drawing Sheets

TREADMILL APPARATUS THAT MEASURES GAIT PARAMETERS USING FOUR OR FEWER LOAD CELLS

FIELD OF INVENTION

This invention relates generally to devices for measuring gait parameters and more particularly to an apparatus for a treadmill that measures gait parameters using four or fewer force sensors.

BACKGROUND

Clinicians working in rehabilitation settings have a need to easily quantify their patients' gait parameters in order to objectively document effectiveness of therapeutic interventions. Historically, however, no equipment has been readily available for them to do so easily. Instead, gait measurement devices have historically come in three variations. One version uses external video capture with markers on the user to identify the real-time location and movement of specific locations on the user. Gait parameters can be extrapolated based upon the location and movement of these markers. This approach requires significant costs for the associated hardware and software. It also requires excessive set up and calibration time to properly place each camera in a location that captures the data appropriately. It also requires a fairly large portion of the room to be dedicated to the video capture system. The comprehensive data provided by these systems is sophisticated and detailed enough to be used for research purposes, and is more than that needed for a typical clinician.

A second version uses multiple force sensors embedded across the entire treadmill deck to sense the vertical force, or load, on the deck. Force sensors are expensive and an array of them is geometrically more expensive. And, although an array of multiple sensors may provide more precise gait measurements, the calculations become increasingly more computationally expensive with more sensors because there is much more data to analyze and more (or more powerful) processors are required. As with the video capture systems, these systems provide more data than would be needed for a typical treating clinician. These systems also require significant modifications to the treadmill to allow for the installation of the instrumented deck.

A third version uses one or more force plates positioned directly below the treadmill belt which sit atop force sensors to sense the load on the treadmill belt as it is transferred to the force plates. Force plate construction is somewhat disadvantageous in that it causes uncertainty in the gait measurements because of friction and vibration between the belt and the force plates. Friction is notoriously difficult to compensate for in gait calculations, due in part to its variability and multi-dimensional effects. In addition, as with the instrumented deck version, significant modifications are needed to implement this type of gait measuring system on an existing treadmill.

Treating therapists typically do not have time to set up a complicated gait recording system, nor can they spend significant money to do so. They also do not need a system that provides an abundance of data—just a few simple parameters that can be compared over time to assess a patient's gait and progress. Given that treadmills are common equipment for rehabilitation clinicians, it would be advantageous to use clinicians' treadmills to measure gait parameters.

Therefore, it is an object of this invention to provide a relatively low cost, simple gait-recording system that provides appropriate gait parameters that can be used daily in the clinic. It is another object to provide a gait measurement system that can be easily retrofitted to a therapist's existing treadmill.

SUMMARY OF THE INVENTION

This gait analysis apparatus comprises three, and preferably four, vertical force sensors disposed between a treadmill and the ground. When a person walks on the treadmill belt, each force sensor emits an electronic signal proportional to the load on the frame. The sensors measure the load hundreds of times per second and that data, in combination with the speed of the treadmill belt, enables a processing unit to calculate many gait parameters. The resultant calculations are displayed to the clinician in numeric and graphical formats. Due largely to the few number of force sensors, the apparatus is relatively inexpensive compared to existing gait parameter apparatuses and can be easily retrofitted to existing treadmills by either replacing the treadmill's existing ground supports with force sensors or resting the treadmill on top of a frame that has integral force sensors.

DETAILED DESCRIPTION OF THE INVENTION

Figure 1:
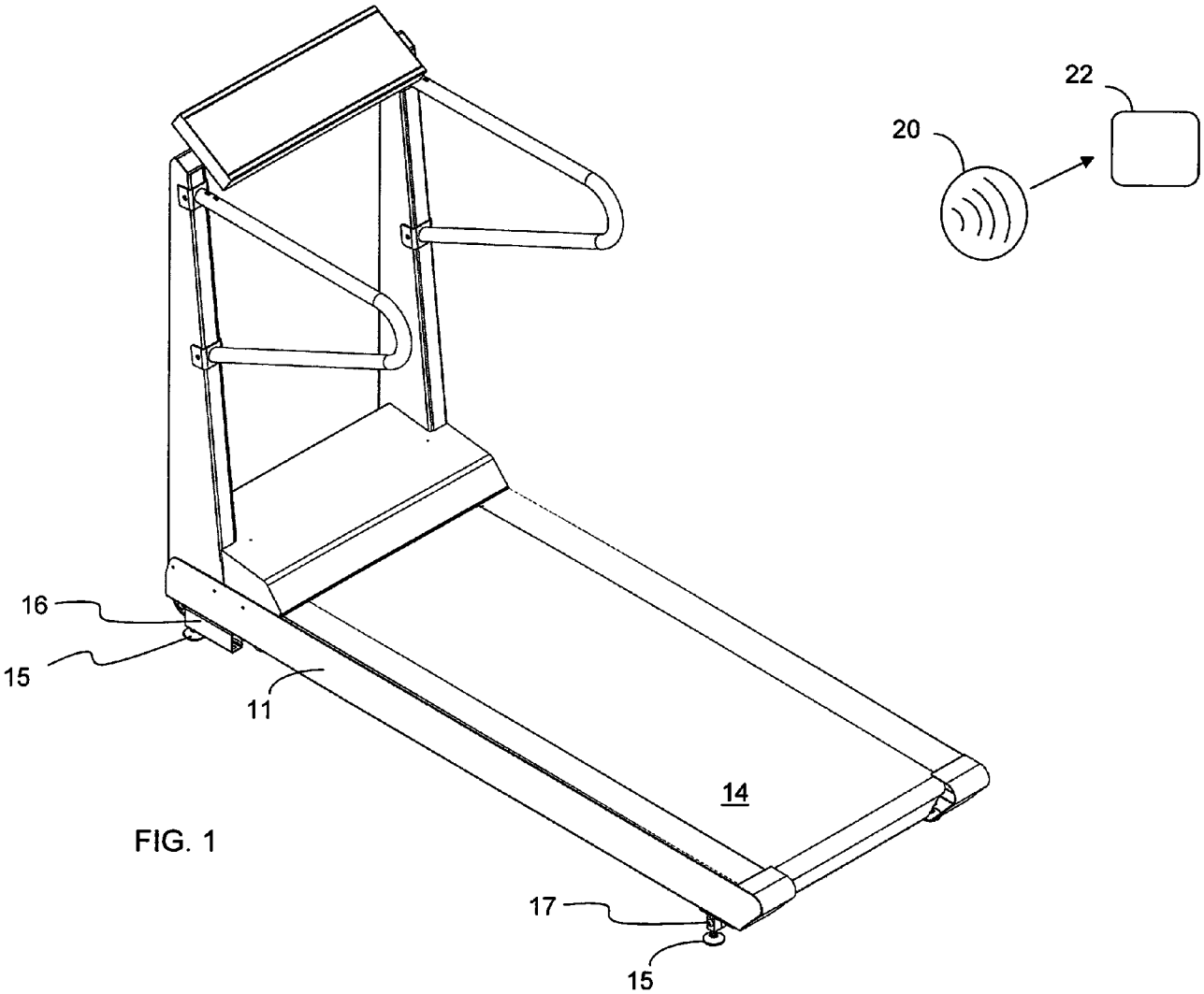
FIG. 1 is a top perspective view of a treadmill with the gait apparatus attached.
Figure 2:
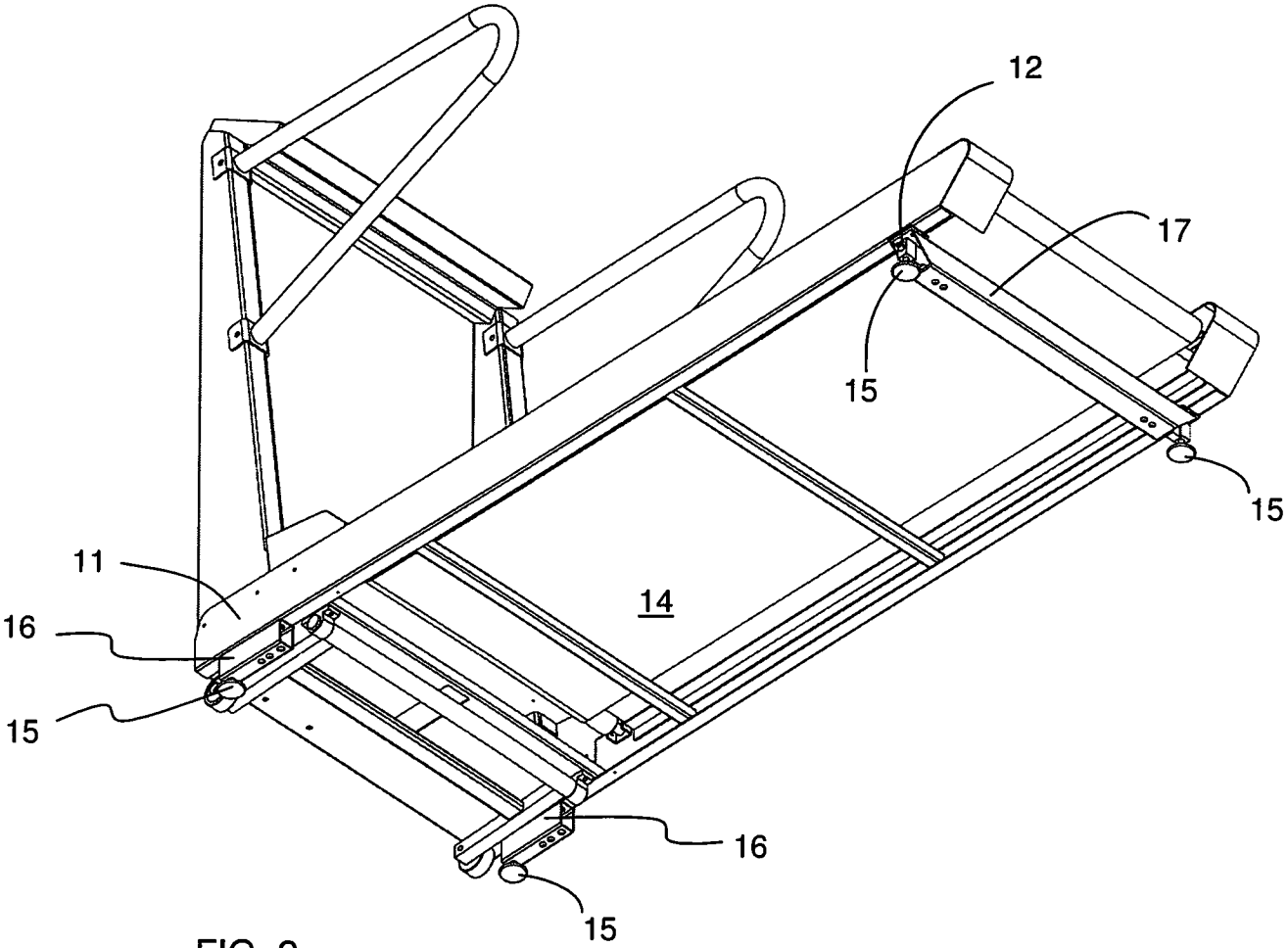
FIG. 2 is a bottom perspective view of the treadmill of FIG. 1.
Figure 3:
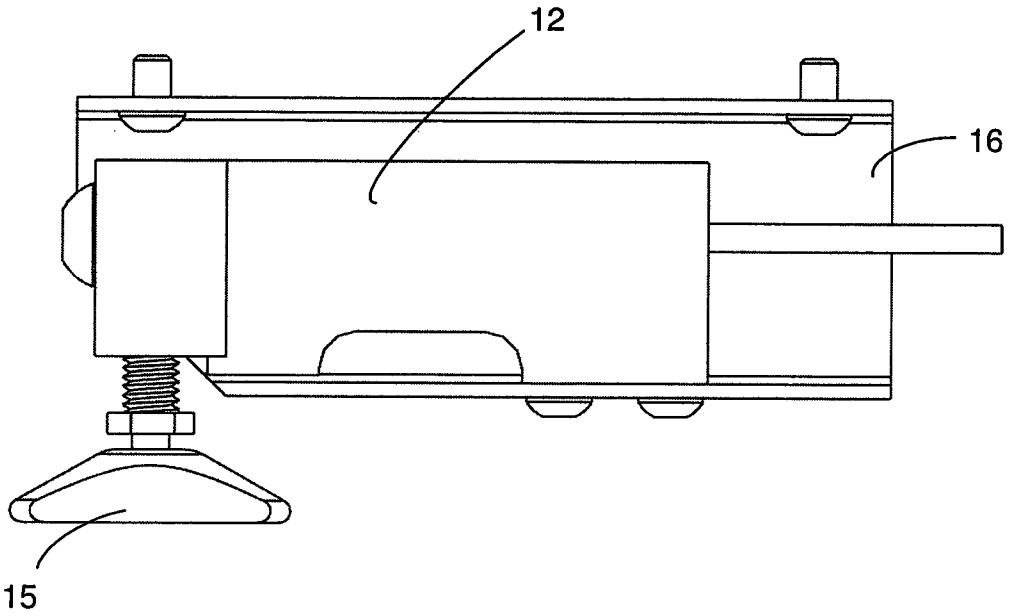
FIG. 3 is a cut-away side view of a load cell in a housing.
Figure 4:
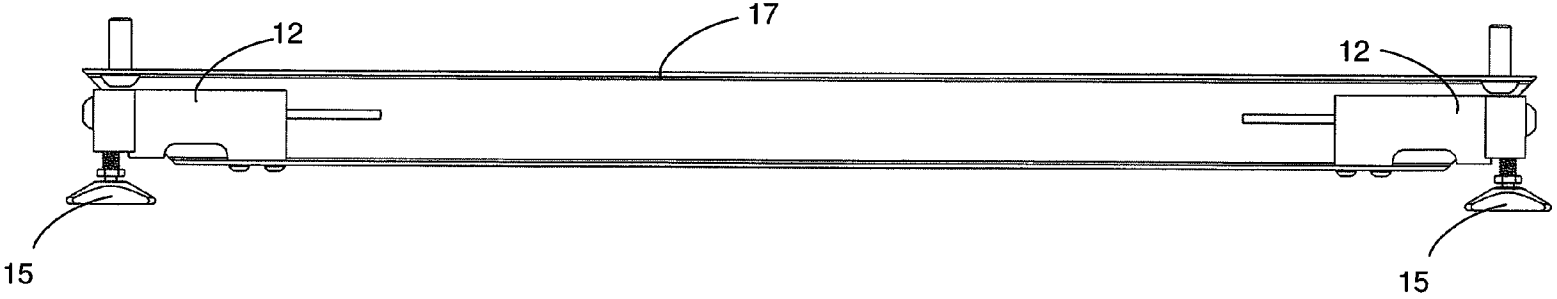
FIG. 4 is a cut-away side view of the rear housing showing the two load cells and feet.

FIGS. 1 and 2 illustrate the gait analysis apparatus in which force sensors 12 in housings 16 and 17 are disposed between the treadmill base 11 and the ground. In the preferred embodiment an adjustable foot 15 is disposed between each force sensor and the ground, as shown in FIGS. 3 and 4. An endless treadmill belt 14 is connected to the base 11, typically over at least two rollers within the base 11. The belt 14 has an upper surface which serves as walking surface for the patient. When the patient walks on the belt 14 the load is transferred to the base 11, which in turn causes each force sensor 12 to emit an electronic signal proportional to the load on the base 11.

The load of the treadmill plus the patient is transferred through the force sensors 12 to the adjustable foot 15, then to the ground. Each force sensor 12 senses the change in the load and transmits a signal proportional to the load to a receiver 20 which in turn transmits the signal to one or more processing units 22. The speed of the treadmill belt is measured as either a digital pulse or actual scalar value. Most treadmills have a simple method for measuring speed for feedback, be it through signals emitted from a magnetic sensor and embedded magnets in the roller pulley or an encoder directly on the motor providing servo feedback. These signals are all simply a digital pulse that occurs a certain number of times per rotation of the motor. Another less sophisticated but nonetheless functional option is to place an optical reflective sensor in the treadmill and paint or stick reflective marks on a rotating component and measure the time between signal pulses generated by the sensor. Regardless of method to measure speed, the present system measures time between signal pulses and divides a treadmill-specific constant by this number to obtain speed.

This system will inherently have three functions: measurement, data acquisition, and processing. Discrete and integrated circuits may be employed. The measurement is accomplished by the force sensors and speed sensor. The data acquisition takes the sensor signals and translates them into something that can be interpreted by a computer, in this case converting the analog signal to digital. This may also include filtering and amplification of the signal. The processing performs the gait analysis and hosts the user interface. Communications may be made by wire or wirelessly. Preferably these communications are made wirelessly via USB, Bluetooth, or other wireless communication protocol.

Software installed on host system uses the load data and speed of the treadmill belt 14 to calculate a multitude of common gait parameters including step length, stride length, symmetry, swing and stance phase percentages. The system measures static load at the center of pressure on each foot at hundreds of times per second, approximating real-time movement measurements. After subtracting the load of the system without the patient, i.e. the tare load, the load values and the known geometry of the sensor locations are used to calculate the location and magnitude of the center of pressure for each data point. Static analysis principles are used to calculate the gait parameters. For example, the ratio of the sum of the front load measurement(s) minus the sum of the rear load measurements, divided by the sum of all load measurements gives a single static load data point. In a preferred embodiment, force sensor and speed sensor data is acquired at a rate of 250 data points per second. In a specific embodiment, the force sensors 12 output a small voltage that changes relative to the load on them. Those signals are transmitted to a data acquisition board which amplifies and filters them, and then converts them to digital values. This is preferably performed by a microprocessor which also reads the digital pulse from the speed sensor and measures the time between consecutive pulses. The data acquisition board is connected to a host system, such as a tablet, computer, smartphone, or other device having one or more processors. Software installed on the host system dues additional; computation and analysis using the force sensor and speed data.

Figure 5:
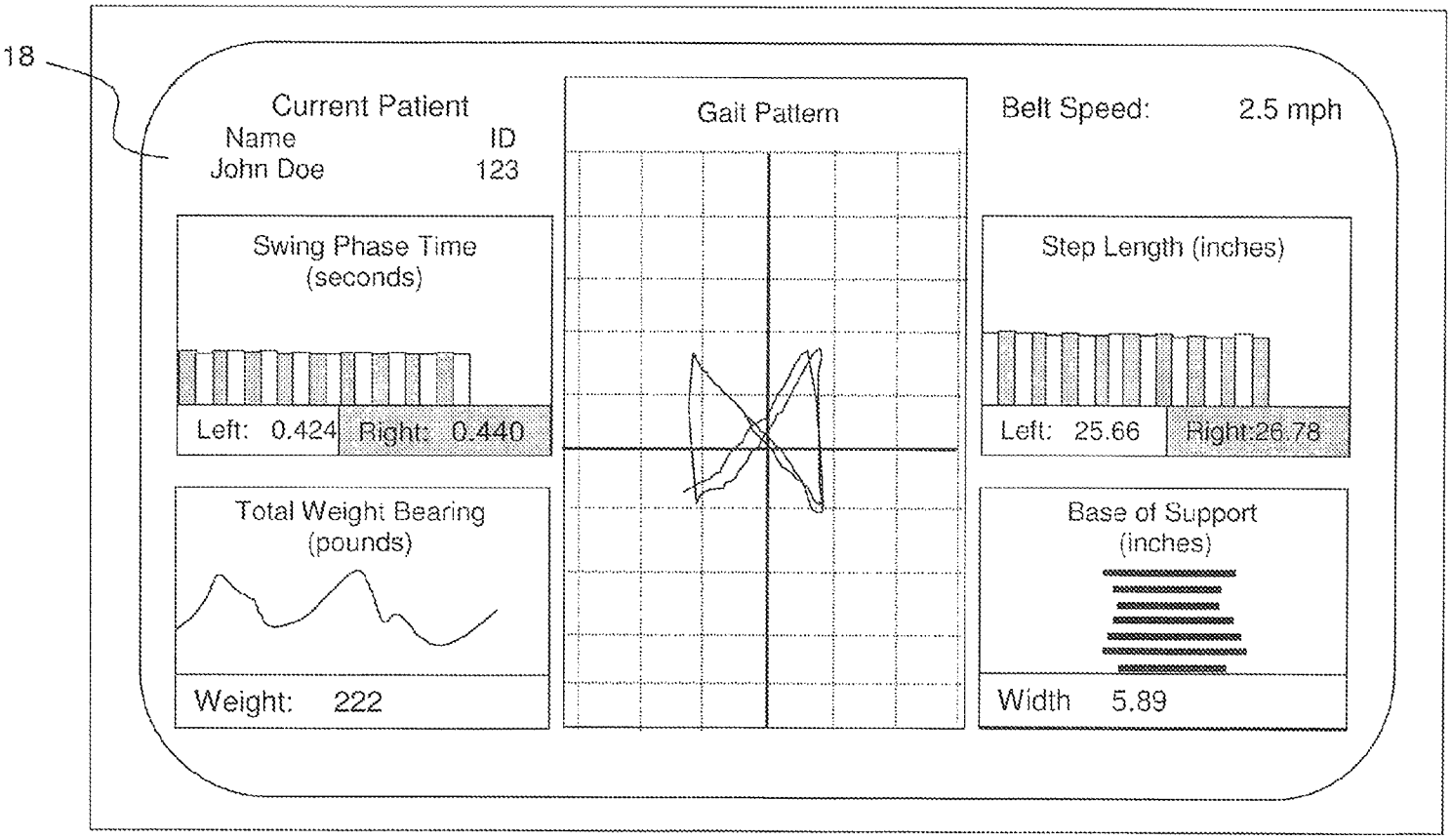
FIG. 5 is a sample display of a patient's gait parameters.

The unique pattern created by the center of pressure during gait is analyzed to determine the occurrence and location in both time and two-dimensional space of the four distinct gait events: heel strike and toe off for each foot. FIG. 5 shows a display 18 of certain parameters measured by the apparatus, including swing phase time, step length, total weight bearing, base of support, and a map of the center of pressure through the gait cycle, referred to herein as a gait pattern. This can be accomplished in various ways by observing the deviation of the location of the center of pressure during these events. For instance, when only one foot is in contact with the treadmill belt and the other is in swing phase, the lateral movement of the center of pressure is limited to the width of the footprint and is therefore small in velocity. At the same time, coronal movement is approximate to the speed of the treadmill belt, with only the transition of load from the heel to the ball to the toe causing minor deviation from it. Upon heel strike of the opposing foot, the center of pressure immediately shifts quickly away from the stance foot in one or both directions, depending on the user's gait. Similarly, upon toe off of the first foot, the angular velocity immediately stabilizes to the confines of the opposing foot as previously described. Both deviations can be monitored independently, such as via differentiation, or correlatively. The latter can be done by calculating the direction of the velocity vector of the center of pressure. Once an event is deemed to have occurred within a window, the precise location and timing of the event is estimated by searching this window of data points for the exact location of the substantive change in direction. This method has the advantage of being able to detect events even in the case of some crossover or short-stepping, making it ideal for analyzing asymmetric gait. Once the location and timing of heel strike and toe off for each foot are known, a complete analysis of gait parameters can be performed on the data.

Figure 7:
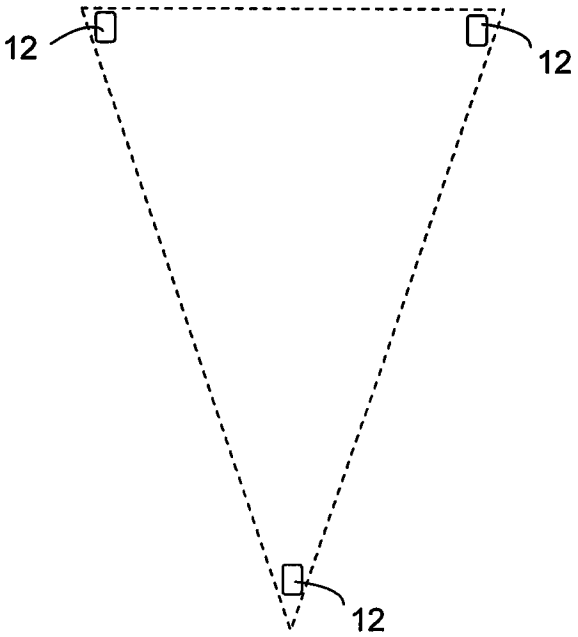
FIG. 7 illustrates the relative positions of force sensors in a triangular arrangement.
Figure 6:
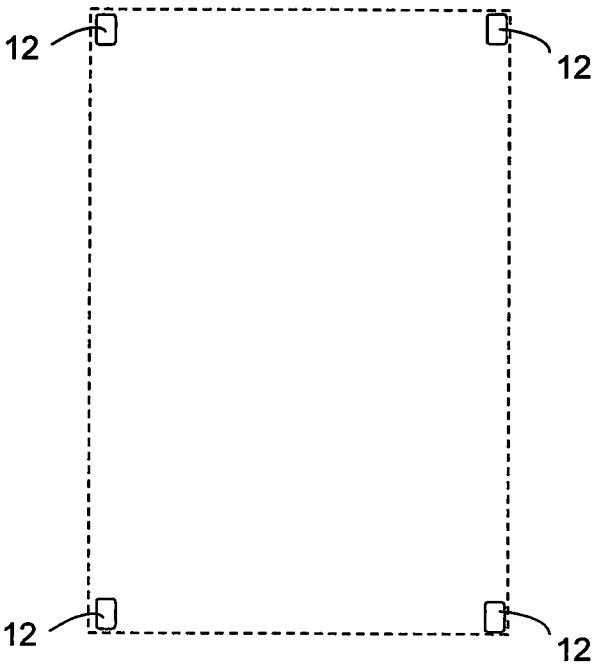
FIG. 6 illustrates the relative positions of force sensors in a rectangular arrangement.

Any form of force sensor may be utilized. Preferably a cantilever beam-style strain gauge is used, as shown in FIGS. 3 and 4, and these are available commercially. The force sensors 12 are rigidly connected to each other. Typically four force sensors are employed, arranged in a rectangle, as shown in FIG. 6 in which the dashed rectangle indicates the relative placement of the sensors. The apparatus will also work with three force sensors arranged in a triangle as shown in FIG. 7 in which the dashed triangle indicates the relative placement of the sensors. The three-sensor arrangement is less expensive, but suffers the potential of reduced accuracy and precision, as well as increasing the risk that the treadmill will tip over because the center of the load might fall outside the triangle. If three sensors are used it's preferable to locate the force sensors well beyond the perimeter of the treadmill walking surface. However, given the sensitivity of current force sensors, the reduction in accuracy and precision is not material to the success of therapy and rehabilitation.

The apparatus can be implemented in several configurations. In one, force sensors are integrated directly into the base of the treadmill, a configuration most commonly used for new gait apparatuses. In this configuration one end of the force sensor 12 is mounted to the treadmill base 11 and the other end of the force sensor is attached to the adjustable foot 15 that rests on the ground. The adjustable feet are used to level the treadmill, as known in the art.

In another configuration, modular attachments that house the force sensors are attached to the treadmill base 11, preferably using mounting points that already exist on the base for the ground support. Additional mounting points may be made in the base to provide additional stability and durability, if necessary. There are two types of housings: one housing 16 holds a single force sensor, as shown in FIG. 3, and a second housing 17 holds two force sensors, as shown in FIG. 4. The single-sensor housings 16 are typically used in the front of the treadmill, one on each side of the mechanism that elevates the head of the treadmill belt to create an inclined walking surface. The dual-sensor housings 17 are typically used across the rear of the treadmill where there's no treadmill structure to straddle.

Figure 8:
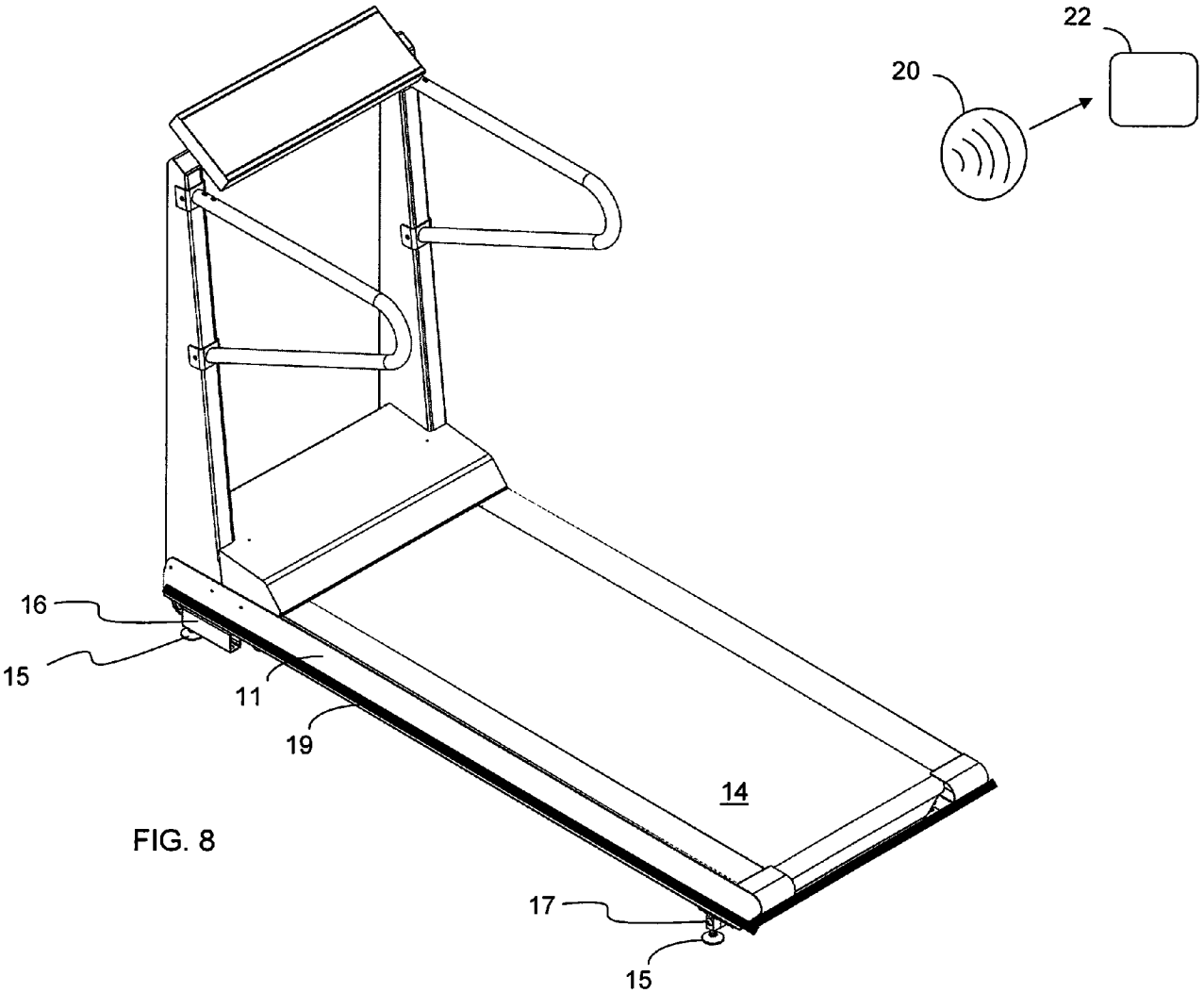
FIG. 8 shows a treadmill resting atop a frame.
Figure 9:
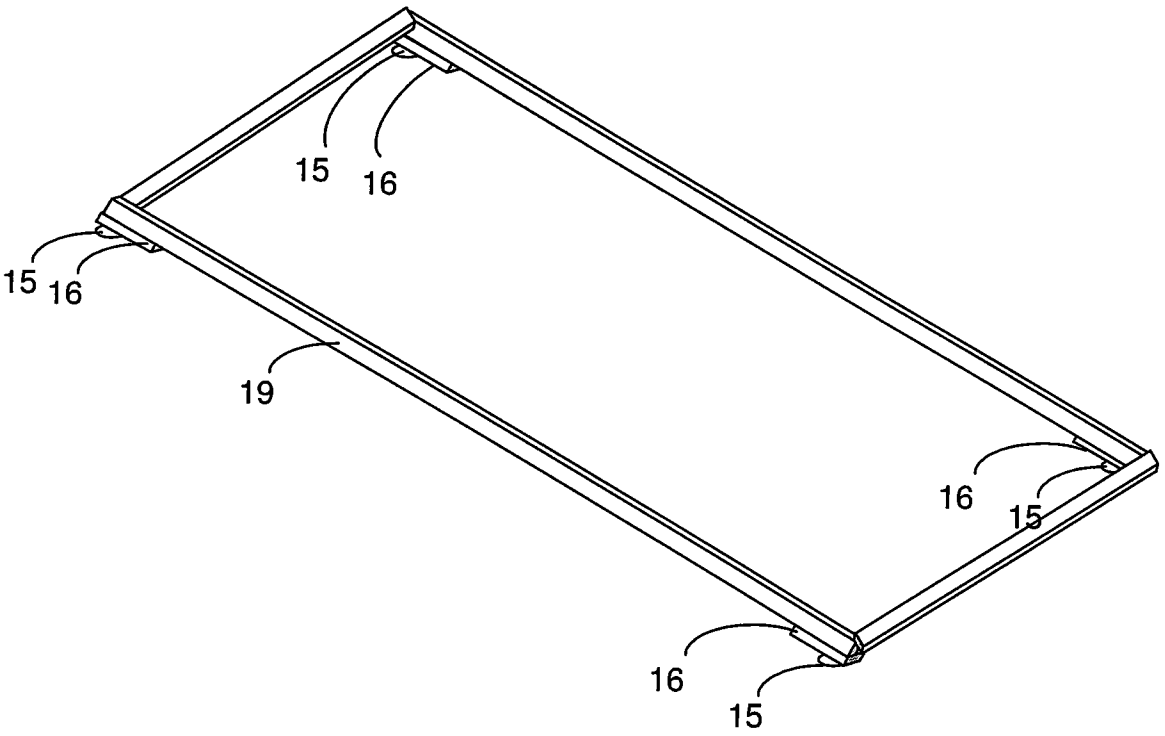
FIG. 9 shows a frame with force sensors in housings and feet.

A third configuration employs an adjustable stand-alone frame 19 that has force sensors 12 in housings 16 and 17 and feet 15 attached to each housing. See FIG. 9. A treadmill is placed on top of the frame 19 and secured to it. In practice, the ground supports of the treadmill are typically removed before the treadmill is placed atop the frame 19. FIG. 8 shows a treadmill sitting atop a frame 19.

While there has been illustrated and described what is at present considered to be the preferred embodiment of the present invention, it will be understood by those skilled in the art that various changes and modifications may be made and equivalents may be substituted for elements thereof without departing from the true scope of the invention. Therefore, it is intended that this invention not be limited to the particular embodiment disclosed, but that the invention will include all embodiments falling within the scope of the appended claims.

We claim:

1. A gait analysis apparatus comprising:

a) a base having a surface closest to the ground;

b) four or fewer force sensors disposed between the base and the ground; and c) a treadmill belt connected to the base that, when walked on, causes each force sensor to emit an electronic signal proportional to the load on the base.

2. The apparatus of claim 1 further comprising:

a) a receiver in communication with the force sensors which receives the signals from the force sensors and transmits them to a processing unit, which calculates one or more gait parameters.

3. The apparatus of claim 2 wherein the parameters comprise swing phase time, total weight bearing, step length, base of support and gait pattern.

4. The apparatus of claim 1 wherein each force sensor is a cantilever beam style load cell.

5. The apparatus of claim 1 wherein:

a) at least one force sensor is disposed in a housing;

b) an adjustable foot that rests on the ground is attached to the housing; and c) the housing is attached to the base.

6. The apparatus of claim 5 wherein the housing replaces a ground support on the base.

7. The apparatus of claim 1 wherein force sensors are integral with base.

8. The apparatus of claim 1 comprising four force sensors.

9. The apparatus of claim 1 wherein the force sensors are removable.

10. A gait analysis apparatus using a treadmill, the apparatus consisting of:

a) a base having a surface closest to the ground;

b) an endless belt operable over at least two rollers within the base, the belt having an upper surface which serves as walking surface;

c) four or fewer force sensors supporting the base, the force sensors disposed between the base and the ground;

d) a receiver in communication with the force sensors on an input side, for receiving data from the force sensors as a result of a patient walking on the belt; and e) a processing unit, which is connected to the analyzing unit on an input side and generates parameters for characterizing the gait of the patient from the force sensor data.

11. The apparatus of claim 10 wherein force sensors are integral with base.

12. The apparatus of claim 10 wherein the parameters comprise swing phase time, total weight bearing, step length, base of support and gait pattern.

13. A gait analysis apparatus comprising:

a) a rectangular frame having a surface closest to the ground;

b) a first, second, third and fourth force sensor disposed near the corners of the frame, each force sensor disposed between the frame and the ground;

c) a receiver in communication with the force sensors which receives the signals from the force sensors when a load is put on the frame; and d) a processing unit which receives the signals from the analyzing unit to calculate one or more gait parameters of a person putting load on the frame while walking on a treadmill belt disposed above the frame.

14. The apparatus of claim 13 wherein the frame is disposed between a treadmill base and the ground such that the treadmill base rests on the frame.

15. The apparatus of claim 13 further comprising:

a) a first front housing mounted to the frame, the first front housing containing the first sensor; and b) a second front housing mounted to the frame, the second front housing containing the second sensor; and c) a rear housing mounted to the frame, the rear housing containing the third and fourth force sensors.

16. The apparatus of claim 15 further comprising:

a) a first foot attached to the first front housing;

b) a second foot attached to the second front housing; and c) a third foot and a fourth foot, each attached to the rear housing.

17. The apparatus of claim 13 wherein the parameters comprise swing phase time, total weight bearing, step length, base of support and gait pattern.

* * * * *